US005520243A

United States Patent [19]

Freeman et al.

[11] Patent Number: 5,520,243

[45] Date of Patent: May 28, 1996

[54] METAL STRIP CASTING

[75] Inventors: John Freeman, Kahibah; Lazar Strezov, Adamstown; Steve Osborn, Whitebridge, all of Australia

[73] Assignees: Ishikawajima-Harima Heavy Industries Company Limited, Tokyo, Japan; BHP Steeel (JLA) Pty Ltd, Sydney, Australia

[21] Appl. No.: 284,466

[22] PCT Filed: Nov. 22, 1993

[86] PCT No.: PCT/AU93/00593

§ 371 Date: Aug. 15, 1994

§ 102(e) Date: Aug. 15, 1994

[87] PCT Pub. No.: WO95/09110

PCT Pub. Date: Apr. 6, 1995

[30] Foreign Application Priority Data

Nov. 30, 1992 [AU] Australia ..... PL6083

[51] Int. Cl.[6] ..... B22D 11/06; B22D 11/04

[52] U.S. Cl. ..... 164/478; 164/479; 164/480; 164/428; 164/429; 164/416

[58] Field of Search ..... 164/478, 416, 164/480, 428, 479, 429

[56] References Cited

U.S. PATENT DOCUMENTS 5,390,726 2/1995 Fukuda et al. ..... 164/478

FOREIGN PATENT DOCUMENTS 1-218744 8/1989 Japan ..... 164/428

*Primary Examiner*—Kuang Y. Lin

*Attorney, Agent, or Firm*—Nikaido, Marmelstein, Murray & Oram

[57] ABSTRACT

Method and apparatus for continuously casting metal strip (20) of the kind in which a casting pool of molten metal (30) is formed in contact with a moving casting surface. By making the casting surface (16A) very smooth and inducing relative vibratory movement between the molten metal and the casting surface at selected frequency and amplitude, the heat transfer from the solidifying metal is dramatically improved. The casting surface has an Arithmetical Mean Roughness Value (Ra) of less than 5 microns and the induced vibratory movement preferably has a frequency of no more than 20 kHz. This enables improved casting productivity and also produced a marked refinement of the surface structure of the cast metal.

25 Claims, 19 Drawing Sheets

(x50)

(x50)

0.18 Ra; Coarse Structure 9-27-3

K avg. = 15.76
K min. = 10.11
K max. = 22.88
K std. = 0.25

K = 15

0.18 Ra; Refined Structure 9-38-3

K avg. = 32.81
K min. = 26.22
K max. = 38.15
K std. = 0.29

K = 36

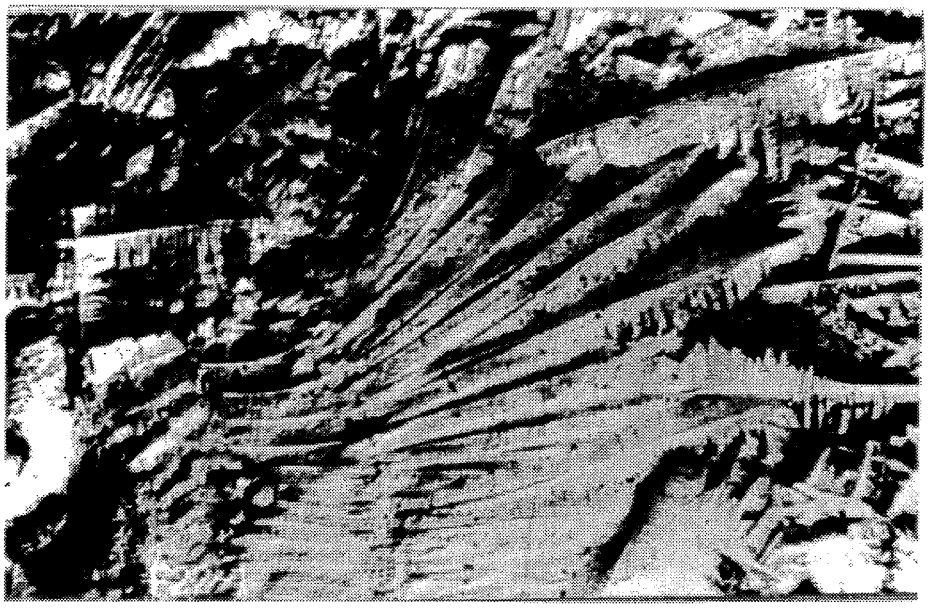
FIG. 8 (x50)
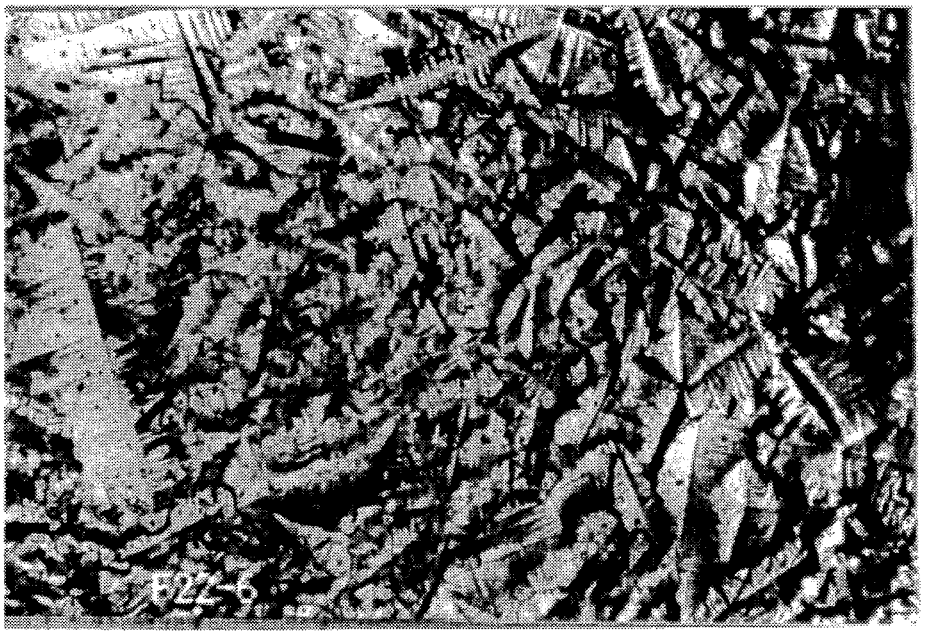
f=4KHz; a=0.6μm (x50)
FIG. 9 f = 4 KHz; a = 1.84 μm (x 50)

f = 4 KHz; a = 4.9 μm (x 50)

(x 50)

f=4 KHz ; a=1·6 μm (x 50)

(x 100)

(x100)

METAL STRIP CASTING

TECHNICAL FIELD

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the 10 moving roll surfaces and are brought together at the nip between them to produce a solidified strip product delivered downwardly from the nip between the rolls. The molten metal may be introduced into the nip between the rolls via a tundish and a metal delivery nozzle located beneath the tundish so as to receive a flow of metal from the tundish and to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals. One particular problem has been the achievement of sufficiently rapid and even cooling of metal over the casting surfaces of the rolls. We have now determined that the cooling of metal at the casting surface of the rolls can be dramatically improved by taking steps to ensure that the roll surfaces have certain smoothness characteristics in conjunction with the application of relative vibratory movement between the molten metal of the casting pool and the casting surfaces of the rolls.

It has previously been proposed in metal casting techniques to apply ultrasonic vibrations to the casting equipment or to the molten metal in that equipment. However these proposals have usually been advanced simply to prevent sticking of solidifying metal on the casting surfaces, to enhance release of gases from the molten metal, to reduce non-metallic inclusions and to promote some internal grain refinement.

U.S. Pat. No. 4,582,117 of Julian H Kushnick discloses the application of ultrasonic vibrations to a casting surface in a continuous casting apparatus. In that case the casting surface is a continuously moving chilled substrate in the form of a moving endless belt extending between a pair of end rolls. The ultrasonic vibrations are applied to the underside of this belt beneath a puddle of molten metal formed where the metal flows onto the belt from a casting nozzle. Kushnick discloses that application of ultrasonic vibrations through the substrate to the melt puddle prior to the critical period of solidification has the effect of enhancing wetting of the substrate and improves heat transfer between the melt puddle and the chilled substrate. These improvements are said to result from the release of trapped air from the molten metal which increases the molten metal/substrate contact area and enhancing wetting of the substrate by the molten metal. As a result, improved heat transfer between the chilled substrate and the molten metal is achieved. As in other prior art proposals to apply ultrasonic vibrations to casting techniques, the vibrations contemplated are in the ultrasonic frequency from 20 to 100 kHz.

The improvements obtained by the application of ultrasonic vibrations simply to enhance wetting and the release of trapped gases and to prevent sticking, although valuable, do not result in a particularly dramatic improvement in the heat transfer between the molten metal and the casting surfaces. We have discovered that by employing casting roll surfaces which are particularly smooth in conjunction with the application of vibratory movements of selected frequency and amplitude it is possible to achieve a totally new effect in the metal solidification process which dramatically improves the heat transfer from the solidifying molten metal. The improvement can be so dramatic that the thickness of the metal being cast at a particular casting speed can be very significantly increased or alternatively the speed of casting can be very significantly increased for a particular strip thickness. The improved heat transfer is associated with a very significant refinement of the surface structure of the cast metals. For steel casting, it has been found that the effective vibration frequency range may be significantly lower than the range of ultrasonic frequencies previously proposed in the prior art processes.

In the ensuing description it will be necessary to refer to a quantitative measure of the smoothness of casting surfaces. One specific measure used in our experimental work and helpful in defining the scope of the present invention is the standard measure known as the Arithmetic Mean Roughness Value which is generally indicated by the symbol $R_a$. This value is defined as the arithmetical average value of all absolute distances of the roughness profile from the centre line of the profile within the measuring length $l_m$. The centre line of the profile is the line about which roughness is measured and is a line parallel to the general direction of the profile within the limits of the roughness-width cut-off such that sums of the areas contained between it and those parts of the profile which lie on either side of it are equal. The Arithmetic Mean Roughness Value may be defined as $$R_a = \frac{1}{l_m} \int_{x=0}^{x=l_m} |y| dx$$

DISCLOSURE OF THE INVENTION

According to the invention there is provided a method of continuously casting metal strip of the kind in which a casting pool of molten metal is formed in contact with a moving casting surface such that metal solidifies from the pool onto the moving casting surface, wherein the casting surface has an Arithmetical Mean Roughness Value ($R_a$) of less than 5 microns and there is induced relative vibratory movement between the molten metal of the casting pool and the casting surface.

More specifically the invention provides a method of continuously casting metal strip of the kind in which molten metal is introduced into the nip between a pair of parallel casting rolls via a metal delivery nozzle disposed above the nip to create a casting pool of molten metal supported on casting surfaces of the rolls immediately above the nip and the casting rolls are rotated to deliver a solidified metal strip downwardly from the nip, wherein the casting surfaces of the rolls have an Arithmetical Mean Roughness Value ($R_a$) of less than 5 microns and there is induced relative vibratory movement between the molten metal of the casting pool and the casting surfaces of the rolls.

The invention further provides apparatus for continuously casting metal strip comprising a pair of parallel casting rolls forming a nip between them, a metal delivery nozzle for delivery of molten metal into the nip between the casting rolls to form a casting pool of molten metal supported on casting roll surfaces immediately above the nip, roll drive to drive the casting rolls in counter-rotational direction to produce a solidified strip of metal delivered downwardly from the nip, and vibration means operable to induce relative vibratory movement between the molten metal of the casting pool and the casting surfaces of the rolls.

It is preferred that the Arithmetical Mean Roughness Value ($R_a$) of the casting surfaces be less than 0.5 microns and may with best effect be less than 0.2 microns.

For casting steels at casting speeds of the order 5 of 30 m/min, the frequency of said vibratory movement may be in the range 0.5 to 20 kHz. However, the optimum frequency will be related to the amplitude of the vibrations.

The surface speed of the rolls will depend on the thickness of the metal being cast but the invention enables a dramatic increase in the range of potential casting speeds up to speeds of the order of 5 m/sec.

In method of the present invention metal solidifies at nucleation sites which are much more closely spaced than has hitherto been possible and produce a much finer surface grain structure than previously achieved.

Preferably the nucleation density is at least 400 nuclei/$mm^2$.

In a typical process according to the invention for producing steel strip the nucleation density my be in the range 600 to 700 nuclei/$mm^2$.

Our experimental work has shown that a critical parameter which influences refinement and the associated dramatic increase in heat transfer is the peak velocity of the vibrational movement. Specifically, this must satisfy a minimum velocity requirement for surface structure refinement. The minimum velocity requirement is influenced by the roughness of the casting surfaces and by the melt properties (density, acoustic velocity and surface tension) but it can be accurately predicted.

BRIEF DESCRIPTION OF THE DRAWINGS

In order that the invention may be more fully explained the results of experimental work carried out to date will be described with reference to the accompanying drawings in which:

FIGS. 8 to 15 are further photomicrographs showing surface structures obtained during tests on melts of 304 stainless steel, A06 carbon steel and 2011 aluminium alloy;

DETAILED DESCRIPTION OF THE PREFERRED EMBODIMENT

Figure 2:
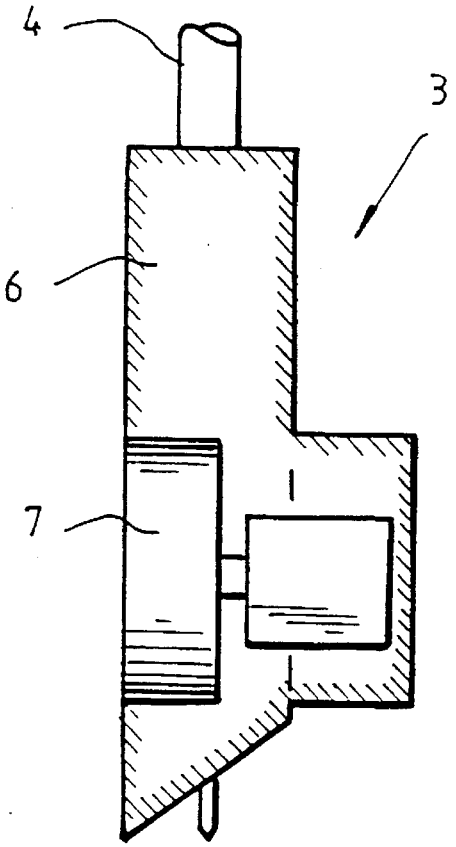
FIG. 2 illustrates an immersion paddle incorporated in the experimental apparatus of FIG. 1.
Figure 1:
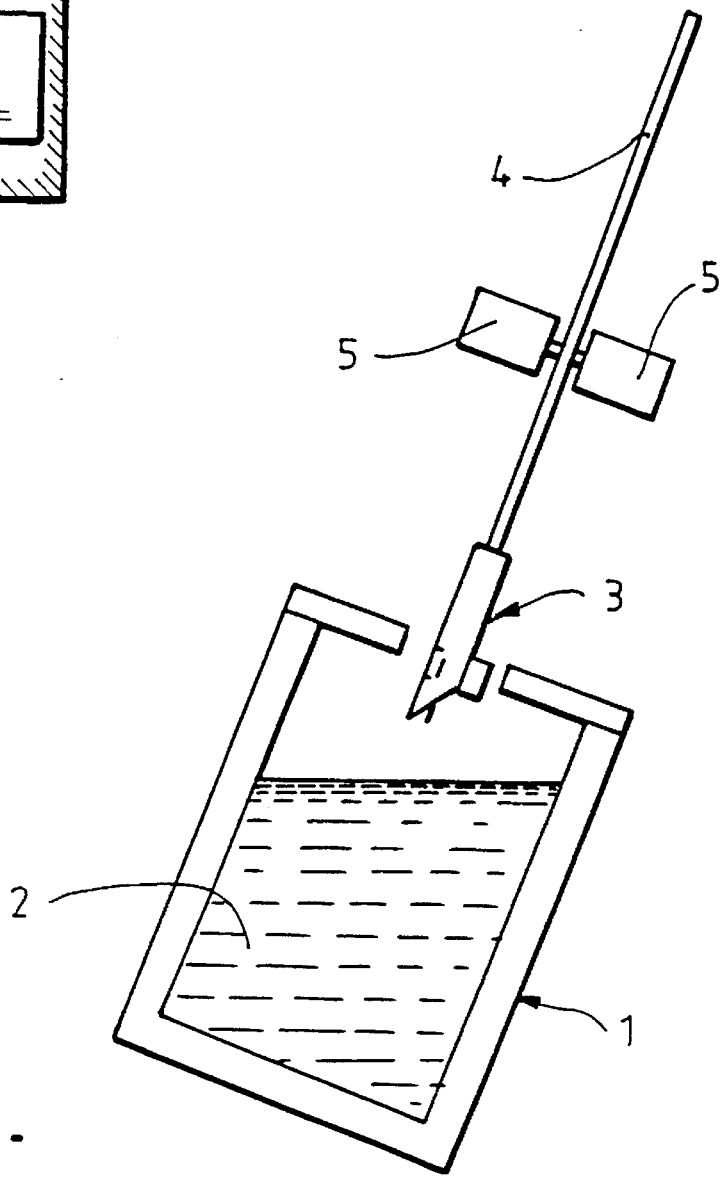
FIG. 1 illustrates experimental apparatus for determining metal solidification rates under conditions simulating those of a twin roll caster.

FIGS. 1 and 2 illustrate a metal solidification test rig in which a 40 mm×40 mm chilled block is advanced into a bath of molten steel at such a speed as to closely simulate the conditions at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and therefore the effective rate of heat transfer at the various locations. It is thus possible to produce an overall solidification rate, generally indicated by the symbol K, as well as a map of individual values throughout the solidified strip. It is also possible to examine the microstructure of the strip surface to correlate changes in the solidification microstructure with the changes in the observed heat transfer values.

An experimental rig illustrated in FIGS. 1 and 2 comprises an inductor furnace 1 containing a molten metal 2 in an inert atmosphere of Argon gas. An immersion paddle denoted generally as 3 is mounted on a slider 4 which can be advanced into the melt 2 at a chosen speed and subsequently retracted by the operation of computer controlled motors 5.

Immersion paddle 3 comprises a steel body 6 which contains a copper substrate 7 and a magnetostrictive transducer 8 used to vibrate the substrate. The substrate is a 18 mm thick copper disk of 46 mm diameter. It is instrumented with thermal couples to monitor the temperature rise in the substrate and an accelerometer to record vibration levels. Magnetostrictive transducer 8 has a Terfernol core of 12 mm diameter and 50 mm length and a maximum operating power of 750 W. Maximum displacement was measured to be 50 microns at 0 Hz.

Tests carried out on the experimental rig illustrated in FIGS. 1 and 2 have demonstrated that the application of vibrations during metal solidification can produce a refined grain structure in the solidifying metal with greatly enhanced heat transfer than can be achieved with the normal coarse grained structure obtained on solidification without the application of vibration. The effect is particularly pronounced if the surface roughness of the chilled casting surface is reduced to low $R_a$ values.

Figure 3:
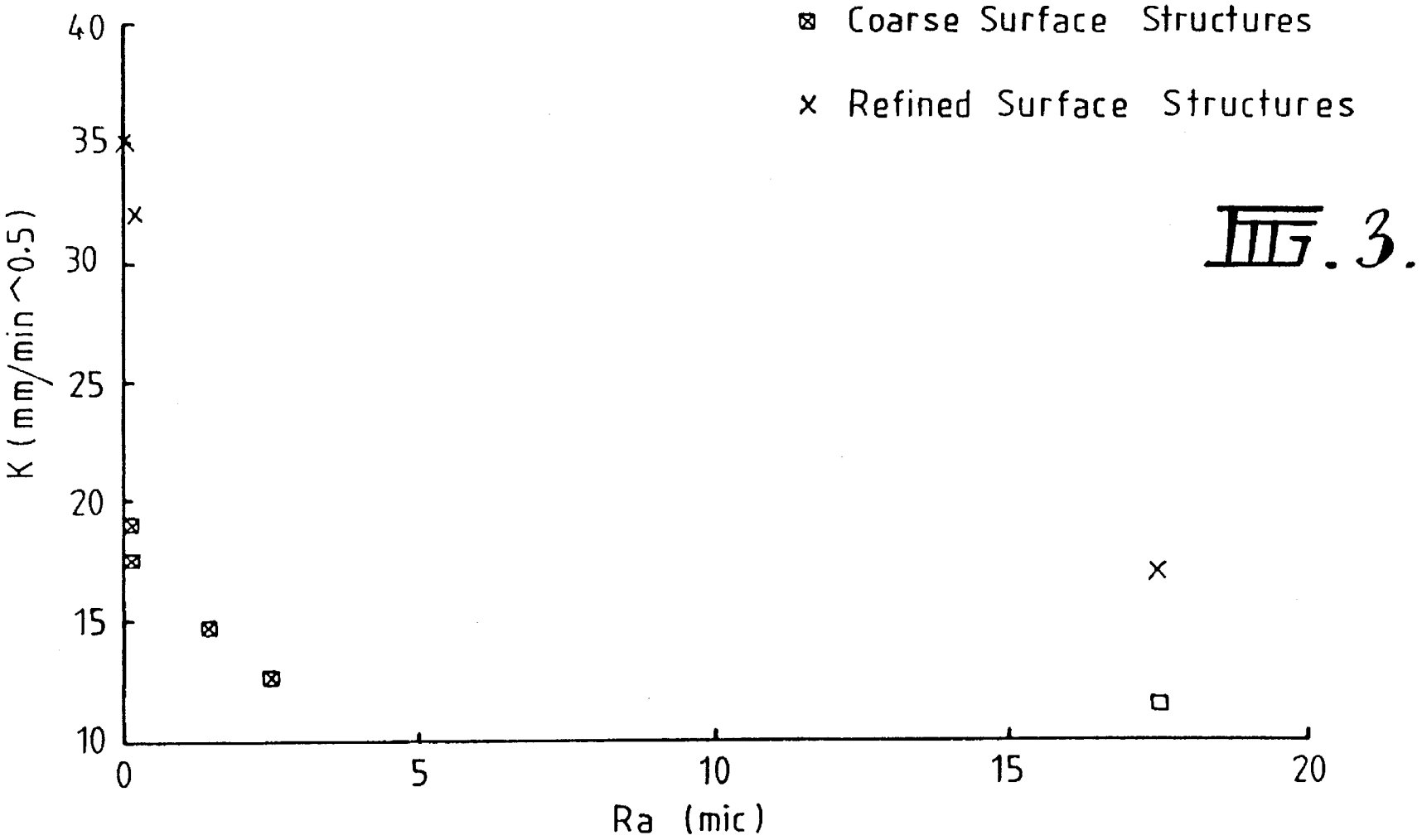
FIG. 3 illustrates solidification constants obtained experimentally using chilled surfaces of varying roughness with and without the application of vibration.
Figure 4:
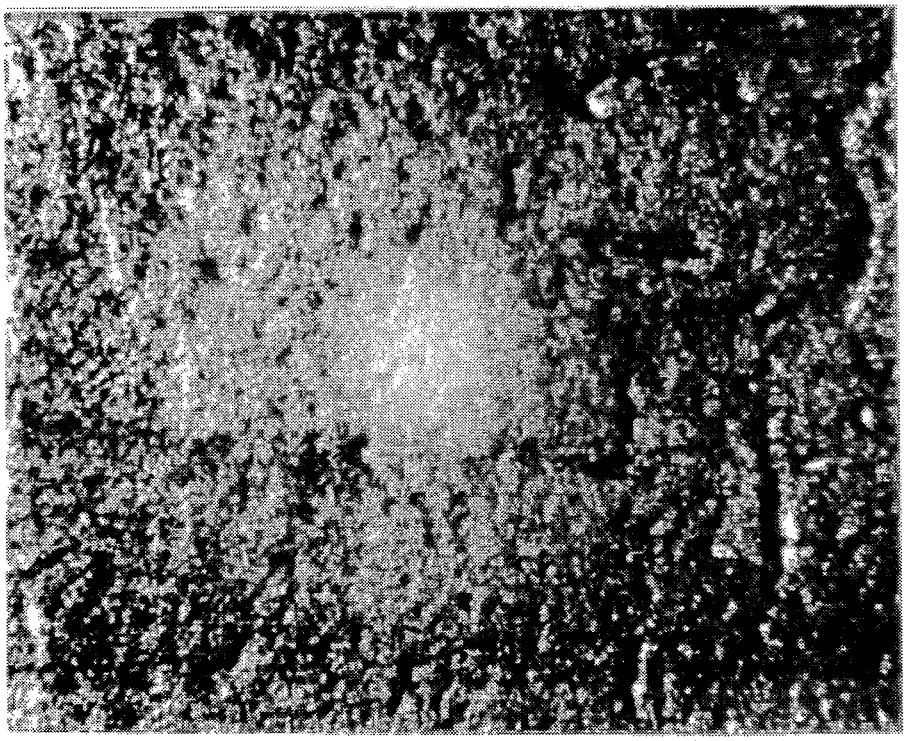
FIGS. 4 and 5 are photo-micrographs showing refined and coarse surface structures of solidified surface metal obtained in the metal solidification experiments from which the data in FIG. 3 was derived.
Figure 5:
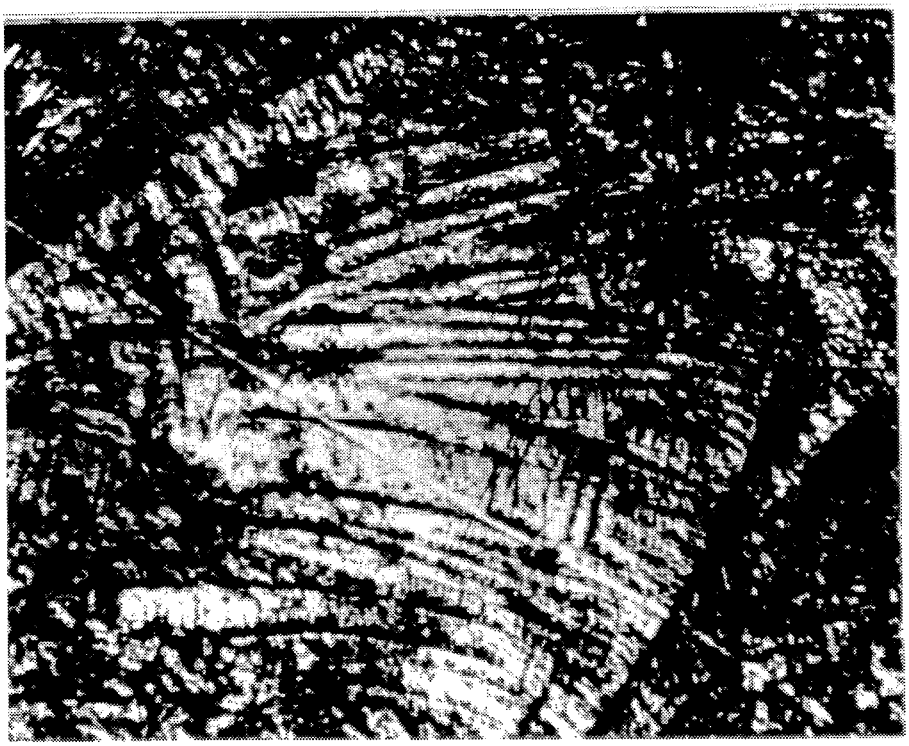
Figure 6:
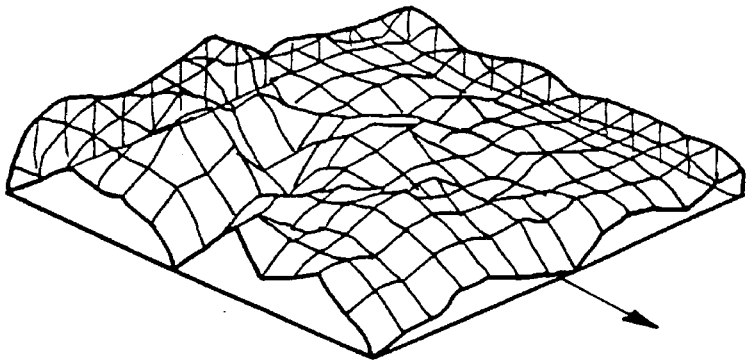
FIGS. 6 and 7 give topographical and heat transfer data on two particular samples of solidified metal produced experimentally.
Figure 7:
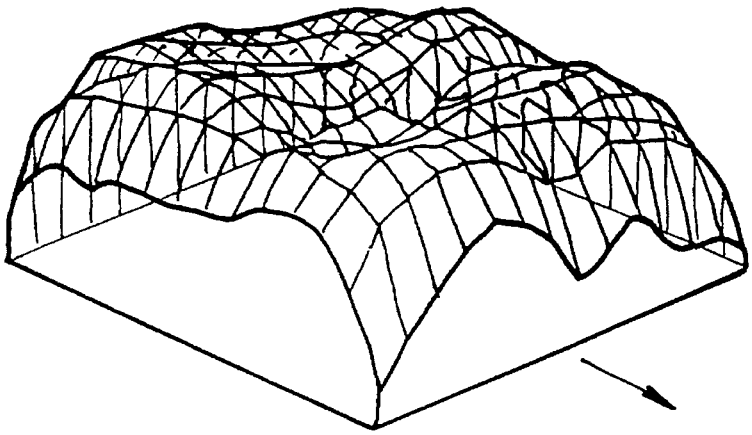

FIG. 3 plots experimental results obtained on solidification of carbon steel onto copper test blocks of varying roughness for an effective roll speed of 30 m/min. The results indicated by the square dots relate to solidified metal strips obtained without the application of vibration. These strips all had coarse surface structures, a typical coarse surface structure being illustrated in FIG. 5. The results indicated by the crosses were obtained on application of vibrations at a frequency of 8–9 kHz. In each of these particular tests the solidified metal strip had a refined surface structure, a typical structure being shown in FIG. 4. It will be seen that even with a relatively rough chilled casting surface with an $R_a$ value of about 17.5 micron there was an improvement in heat transfer as measured by an increase in K value from about 11 to about 17. However, a particularly pronounced enhancement is obtained with chilled casting surfaces of very low $R_a$ values, producing K values in excess of 30. FIGS. 6 and 7 illustrate the enhancement obtained with one particular casting surface with an $R_a$ value of 0.18. Without the application of vibration the measured average overall K value for the resulting solidified strip was 15. On the other hand with the application of vibration at 8–9 kHz a much thicker solidified strip of steel was achieved with an overall K value of 36.

By further experimental work we have shown that the size of the surface solidification structure is determined by the frequency of melt/substrate contacts (nucleation spacing). For a coarse nucleation spacing, typically 1000–2000 microns, the resultant surface structure is dendritic. This is typical when substrate surface roughness of approximately 0.15 to 0.2 $R_a$ is used, without applying vibration. When the substrate is vibrated the nucleation spacing is typically of the order of 20–40 microns and the dendritic nature of the surface structure disappears. The surface of the sample looks like a mirror image of the substrate surface which suggests good wetting at the time of initial melt/substrate contact. On this analysis it is possible to derive a mathematical model to predict vibrational requirements for casting of different metals and alloys. The following nomenclature is required for this purpose:

$\alpha$—vibration amplitude (m)
c—acoustic velocity in the melt (m/s)
d—peak to valley depth as determined from substrate roughness (m)
$h_p$—half pitch distance as determined from substrate roughness (m)
m—roll mass (kg)
p—pressure acting at a solid/liquid interface ($N/m^2$)
$P_{max}$—maximum pressure in the melt due to vibration ($N/m^2$)
P—power (W)
R—radius of curvature (m)
$R_c$—critical radius of curvature needed for complete wetting conditions (m)
$\sigma$—melt surface tension (N/m)
$\rho$—melt density ($kg/m^3$)
$\xi$—refinement coefficient ($m^2/s$)
$\upsilon_{peak}$—maximum substrate velocity due to vibration (m/s)
$\upsilon_{ref}$—vibrational velocity requirement for surface structure refinement (m/s)

The radius of curvature of the melt suspended on two points on the radius substrate surface can be expressed as:

$$R=2\sigma/p \tag{1}$$

Critical radius of curvature for complete wetting conditions, developed from geometrical considerations of the substrate roughness, is defined as:

$$R_c=\frac{h_p}{\sin(180-2\mathrm{arctg}\ d/h_p)} \tag{2}$$

Maximum pressure and velocity in the melt due to vibration can be expressed as:

$$P_{max}=\tfrac{1}{2}\pi^2\rho c f a \tag{3}$$

$$\upsilon_{peak}=2\pi f a \tag{4}$$

Combining (3) and (4), maximum pressure in terms of maximum velocity yields:

$$P_{max}=\tfrac{1}{4}\pi\rho c\upsilon_{peak} \tag{5}$$

Substituting (2) and (5) in (1) and solving for velocity, yields the velocity criterion for refinement:

$$\upsilon_{ref}=\frac{8.\sigma}{\pi\rho c R_c} \tag{6}$$

where surface tension, melt density and acoustic velocity, define the refinement coefficient as a function of melt properties:

$$\xi=\frac{\sigma}{\rho c} \tag{7}$$

Rewriting equation (6) yields:

$$\upsilon_{ref}=\frac{8\xi}{\pi R_c} \tag{8}$$

The power requirement to vibrate a roll can be calculated as:

$$P=2mf\upsilon_{ref}^2 \tag{9}$$

Equations (6) and (8) define the peak velocity requirement for structure refinement as influenced by the melt properties (density, acoustic velocity and surface tension) and substrate roughness.

The above analysis has been verified by the results of tests carried out under the following conditions:

Melt compositions: A06 Carbon Steel, 304 Stainless Steel, Aluminium 2011
Superheat: 100° C.
Immersion Velocity: 0.5 m/s
Substrate Surface Roughness: $R_a$=0.15 to 0.2
Furnace Atmosphere: Argon
Vibration Frequency: 1 to 25 kHz The results of these tests are shown in FIGS. 8 to 19. FIGS. 8, 9, 10 and 11 show the surface solidification structure of 304 stainless steel samples as influenced by vibration.

Figure 10:
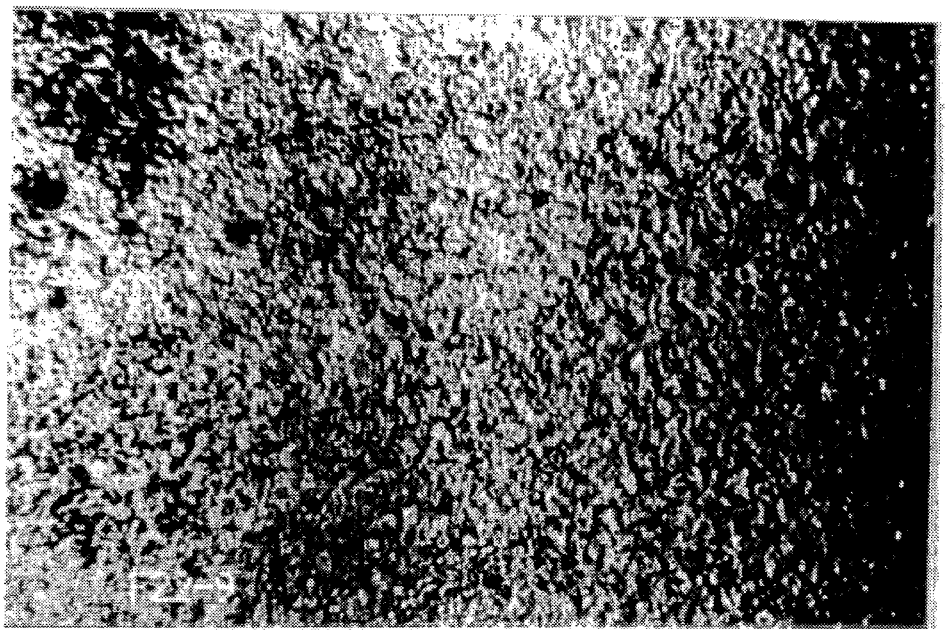
Figure 11:
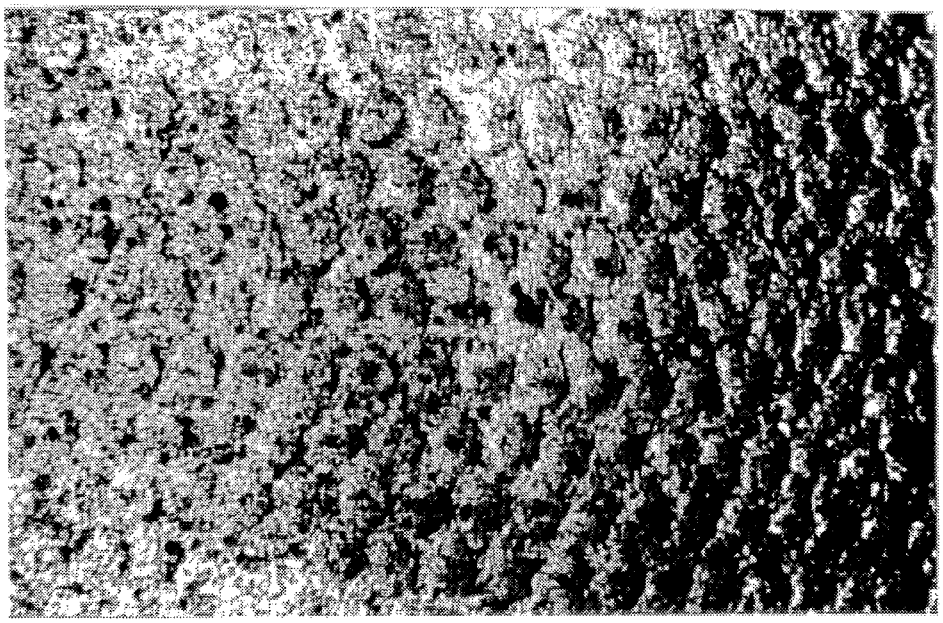

The photomicrograph of FIG. 8 shows a coarse grain structure resulting from a test with no applied vibration. FIG. 9 shows the structure achieved with application of vibration at a frequency of 4 kHz and an amplitude of 0.6 microns. FIGS. 10 and 11 show the structure achieved with vibration at a frequency of 4 kHz and amplitudes of 1.84 microns and 4.9 microns respectively.

It is seen that an increase in vibration amplitude at a given frequency resulted in surface structure refinement from 1–2 grains/$mm^2$ up to 500–1000 grains/$mm^2$. However, at high vibrational amplitudes shell deformation defects are produced as shown in FIG. 11.

Figure 12:
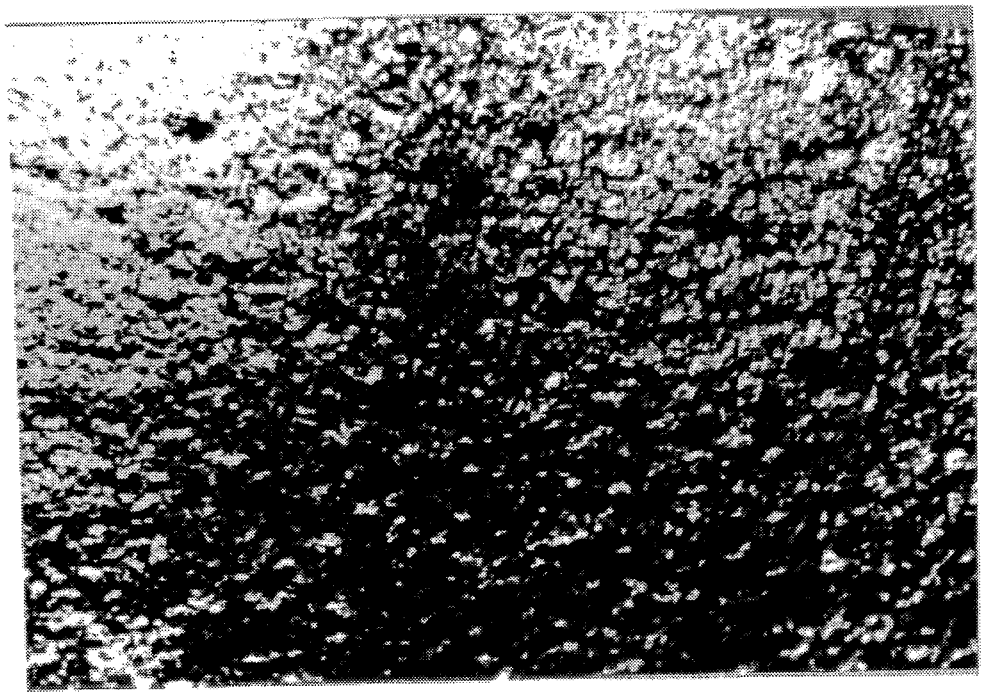
Figure 13:
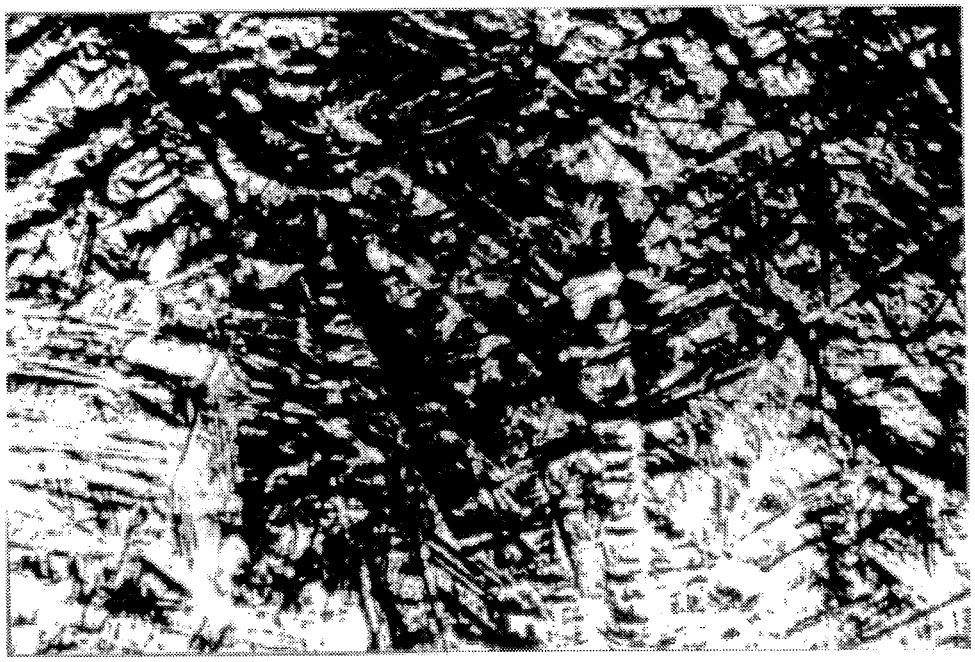
Figure 14:
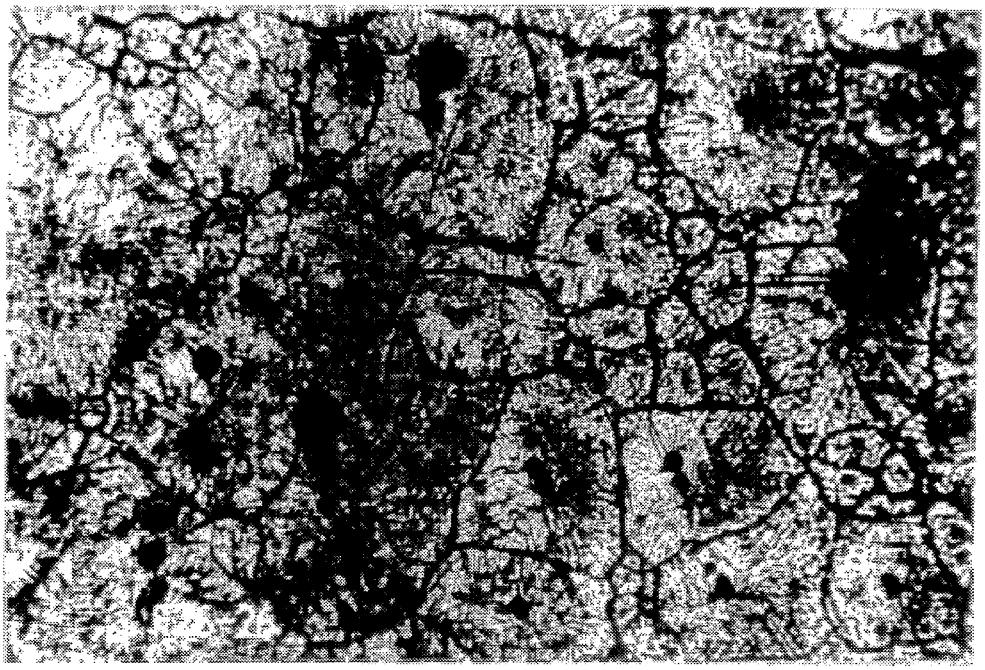
Figure 15:
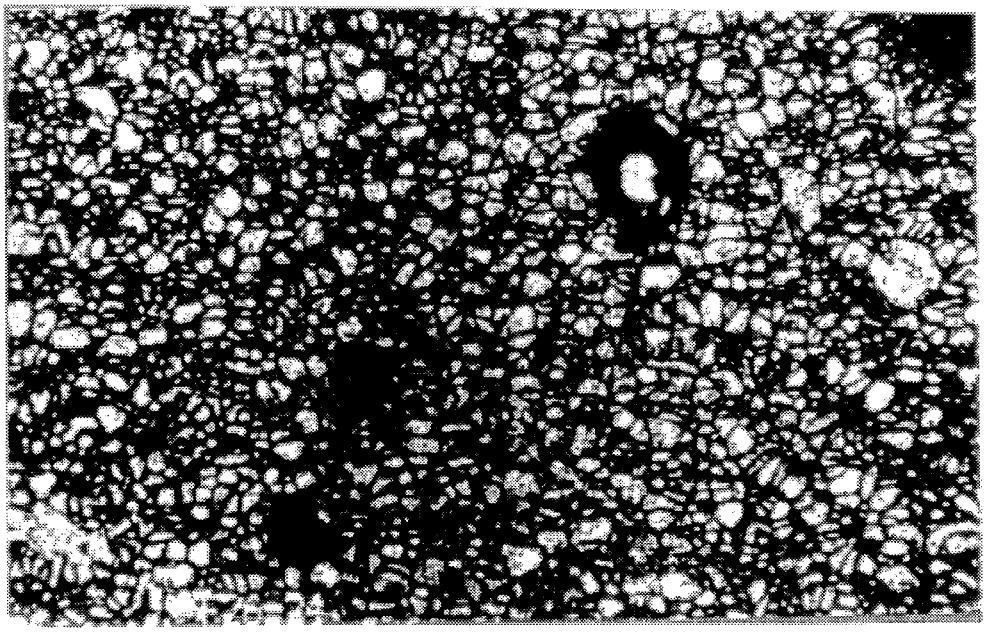

FIGS. 12 and 13 show similar surface structure refinement produced with samples of A06 carbon steel and FIGS. 14 and 15 show similar results achieved with 2011 aluminium alloy.

Figure 16:
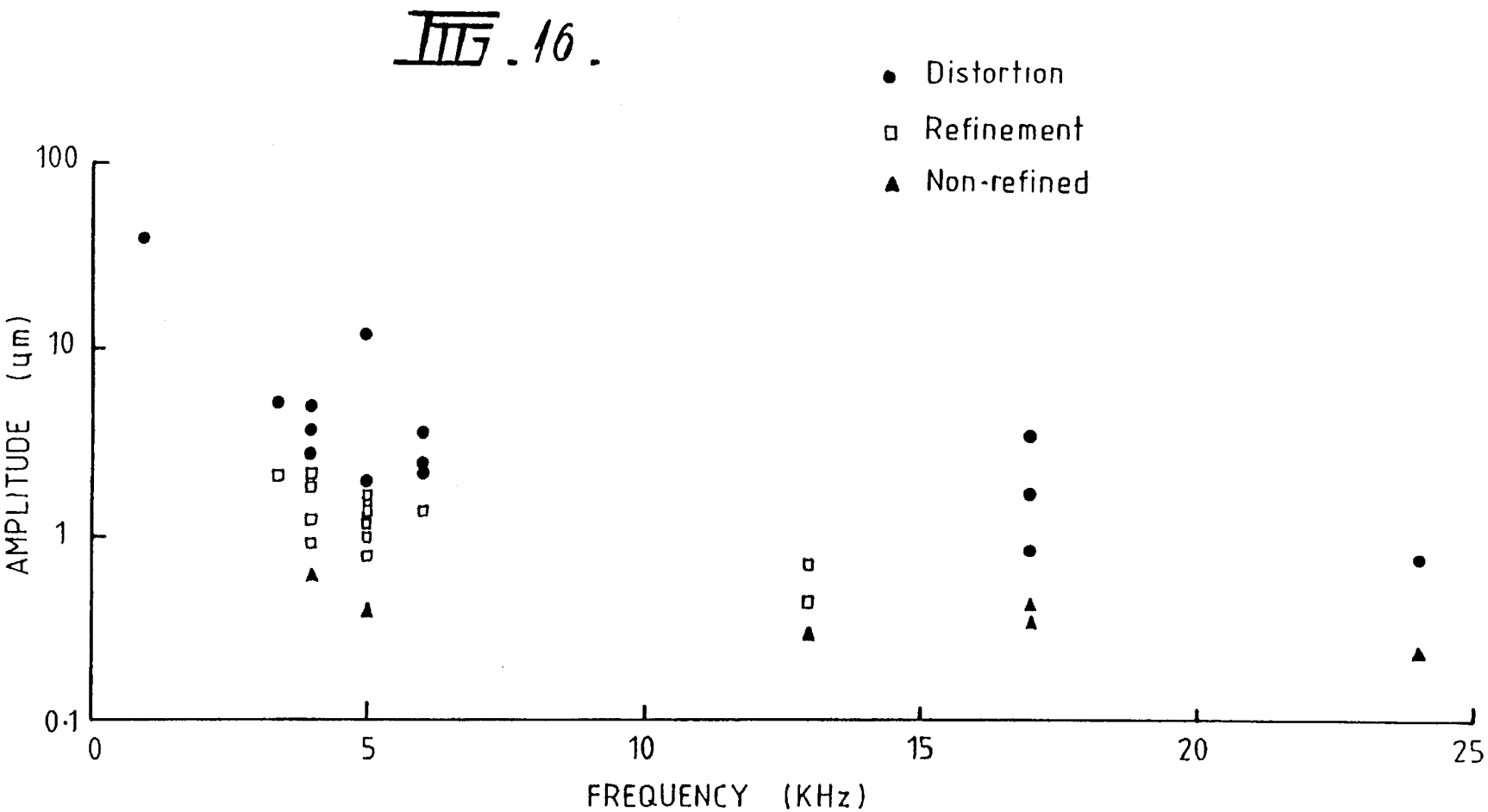
FIG. 16 shows graphically the surface structure achieved with the application of vibration at various frequencies and amplitudes.
Figure 17:
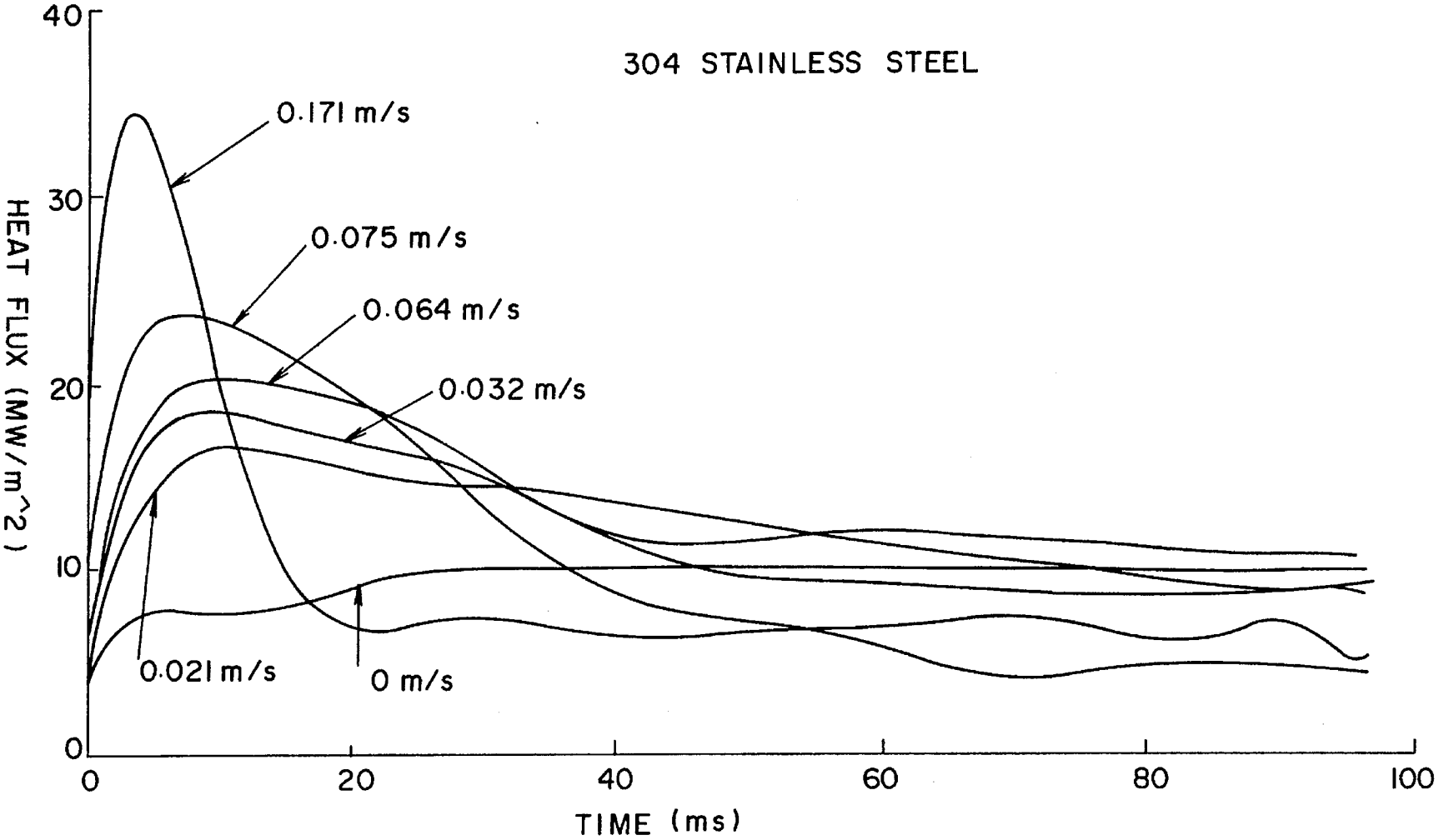
FIGS. 17 and 18 plot heat flux against time during the solidification of 304 stainless steel and A06 carbon steel at various vibrational velocities.
Figure 18:
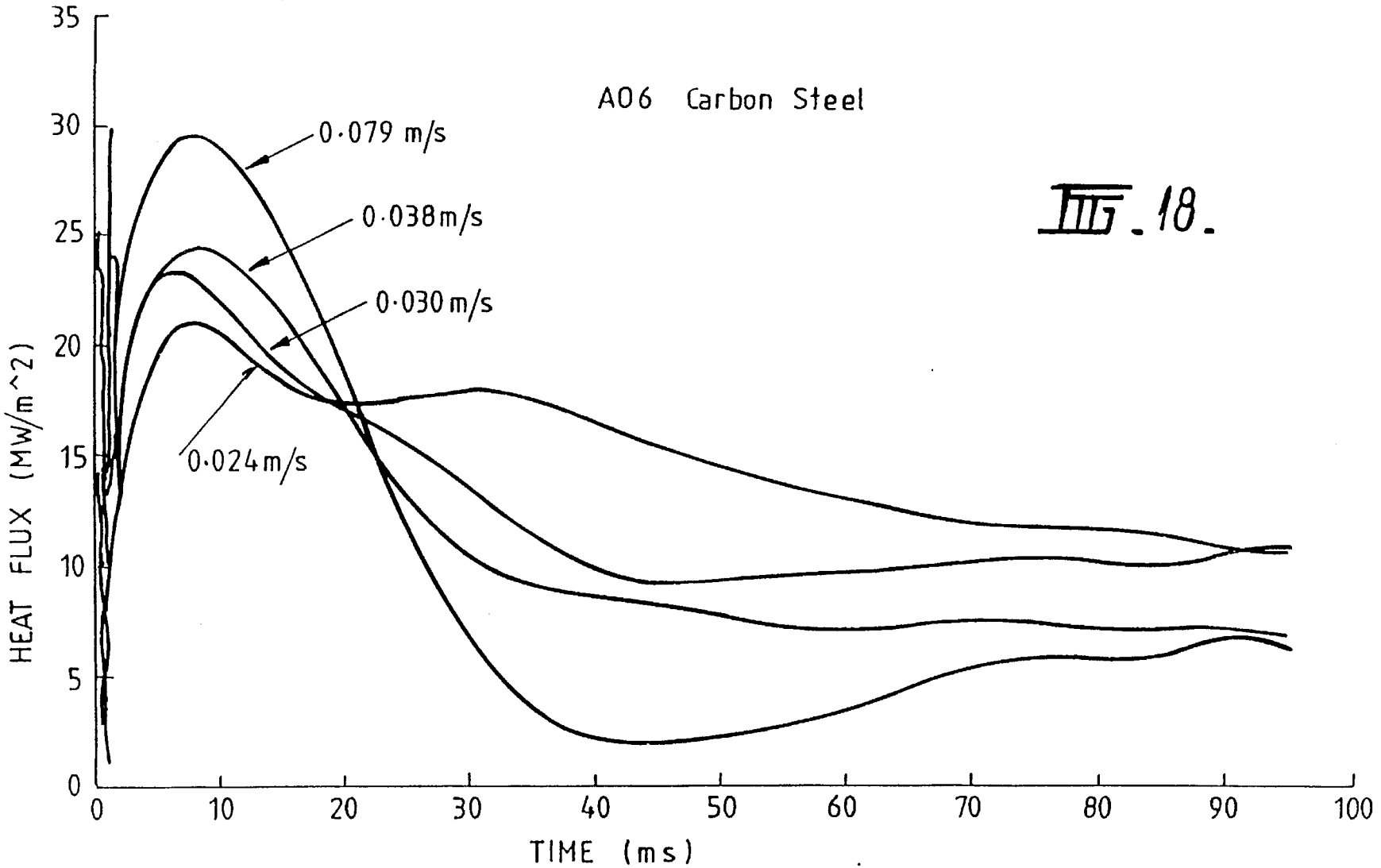

FIG. 16 presents the vibration conditions and the effect on surface structure for 304 stainless steel for various maximum vibrational velocities. In the initial stage of melt/substrate contact, the heat transfer increases with increase in vibration velocity (see equation (4)). At high vibration velocities (0.08 for A06 and 0.17 for 304 stainless steel), the increase in heat flux gives rise to thermal stress in the solidifying steel, causing shell deformation defects as exhibited in FIG. 11. The thickness of samples produced was measured and the effect of vibration velocity on the thickness improvement achieved with 304 stainless steel and A06 carbon steel is summarised in FIGS. 19 and 20. At optimum vibration velocity, thickness improvement, both for 304 stainless steel and A06 carbon steel is typically 40–50%.

Figure 19:
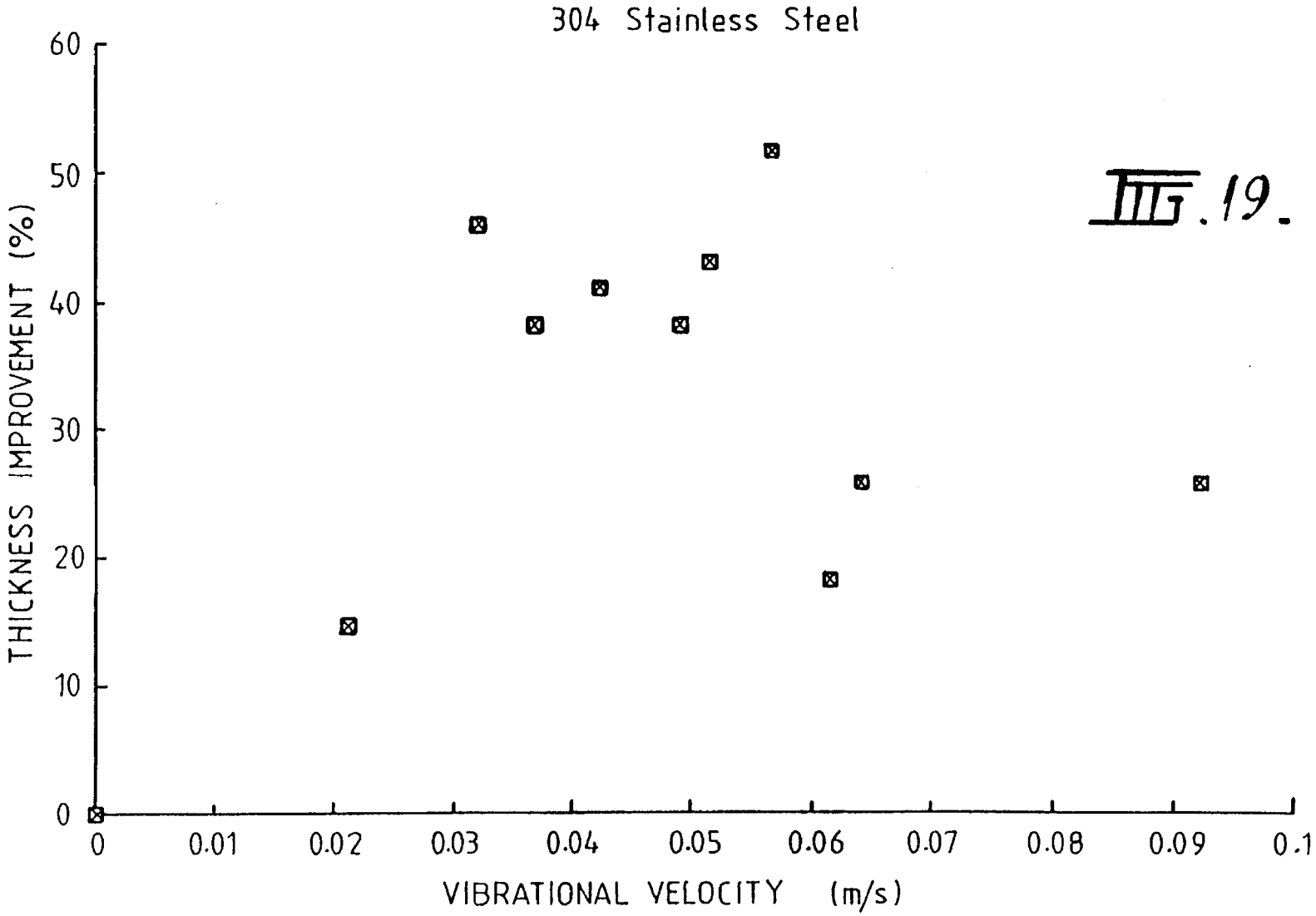
FIGS. 19 and 20 show the effect of vibrations at various velocities on productivity as measured by an improvement of thickness of the metal deposited in the experimental apparatus for both 304 stainless steel and A06 carbon steel.
Figure 20:
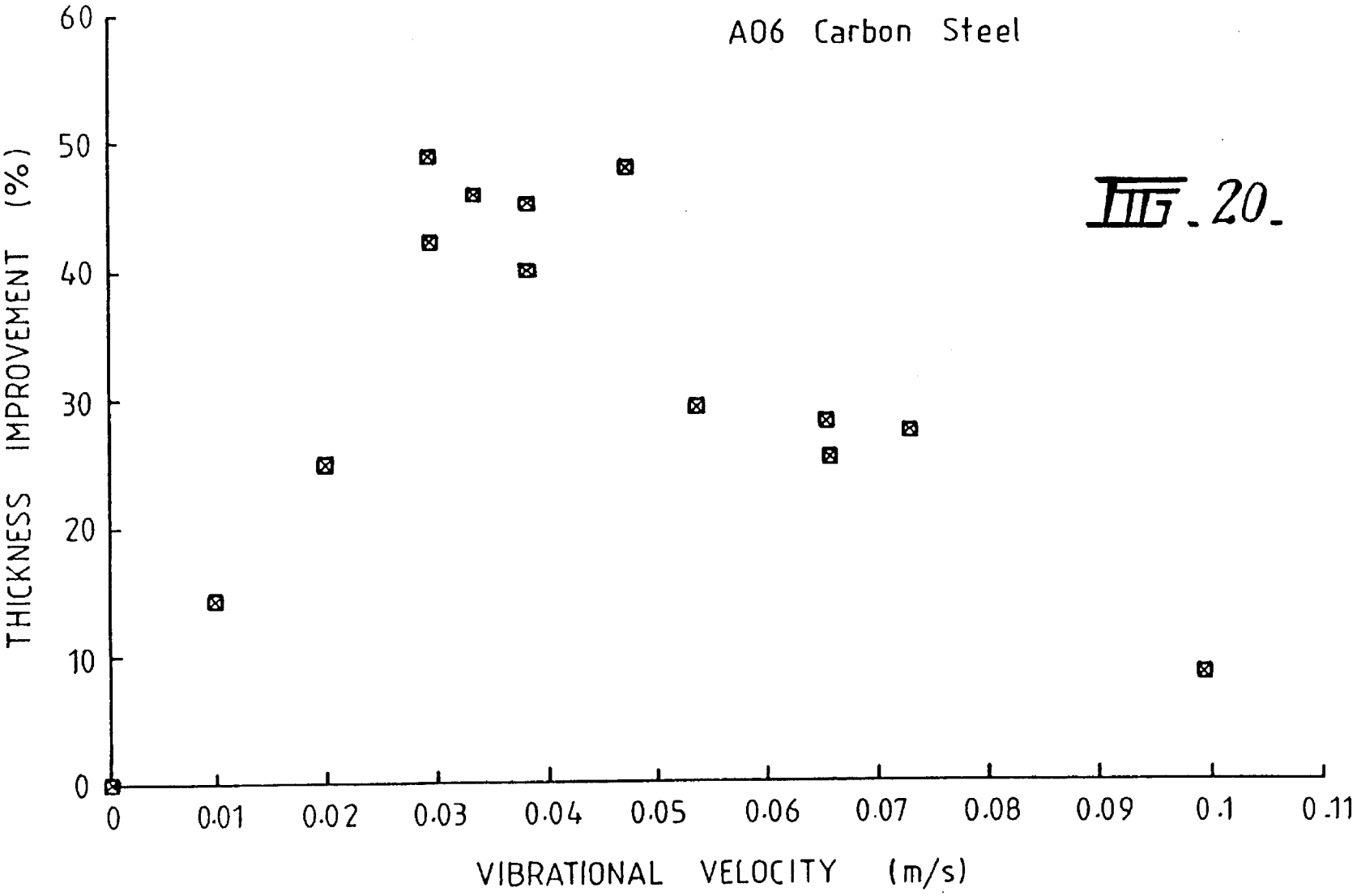

FIGS. 19 and 20 show that significant thickness improvement is achieved over a range of vibration velocities spread about a clearly optimum band. Analysis of these results indicates that useful improvement can be achieved over a range of ±50% of the mid-range velocity. In the case of 304 stainless steel as illustrated in FIG. 19, useful thickness improvement may be achieved over a range of velocities from 0.02 to 0.06 m/s whereas for A06 carbon steel as illustrated in FIG. 20, useful improvement is achieved for peak vibrational velocities in the range 0.015 to 0.05 m/s. Non-optimum performance at relatively low peak velocities may be practically useful but operation at relative higher peak velocities leads to shell deformation defects of the kind exhibited in FIG. 11. Accordingly, the optimum range of practically useful vibrational velocities may be taken as $$\upsilon_{ref}{}^{+10\%}_{-50\%}$$

Figure 21:
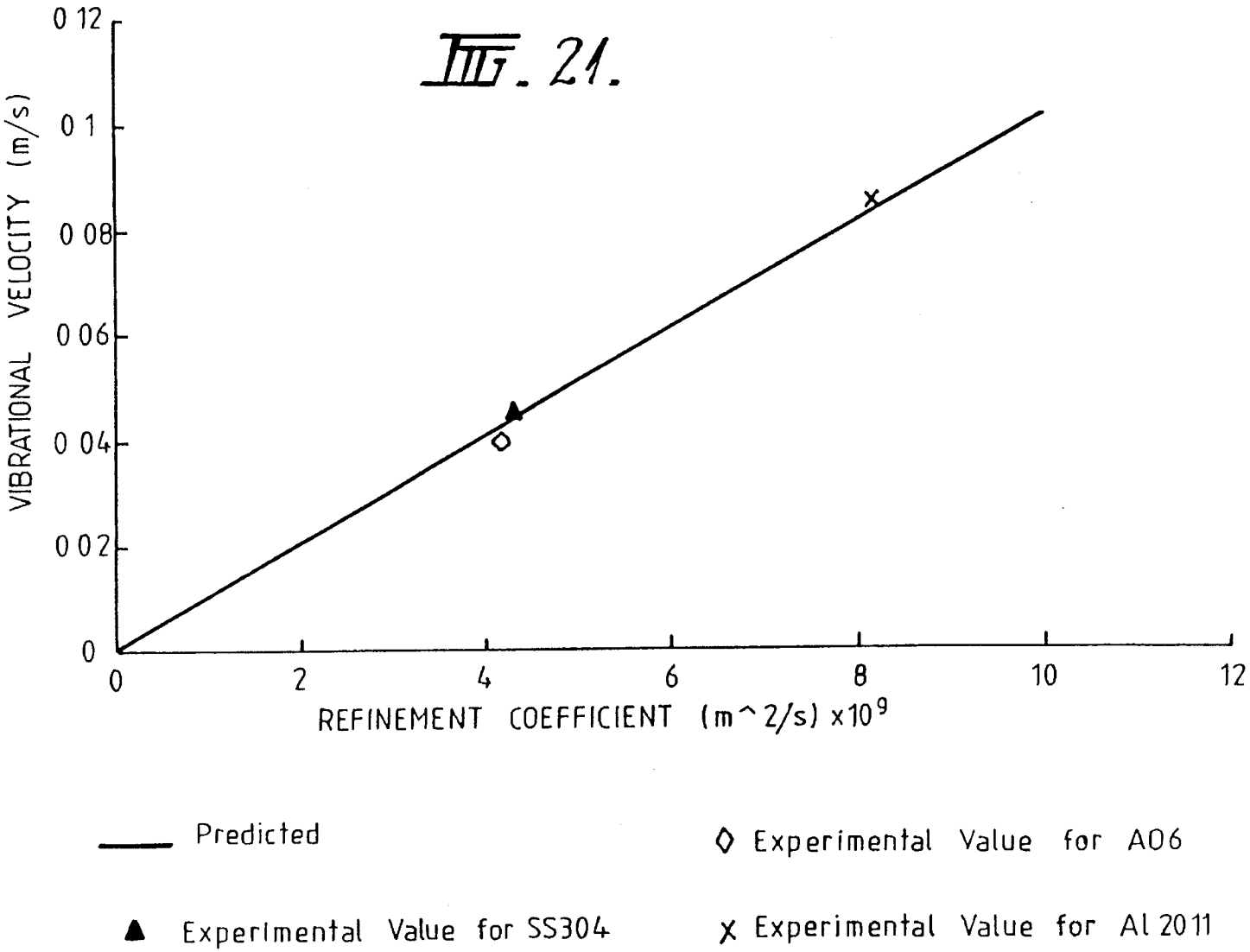
FIG. 21 comprises theoretically predicted vibrational velocity requirements for surface structure refinement with experimentally obtained values for 304 stainless steel, A06 carbon steel and 2011 aluminium.
Figure 22:
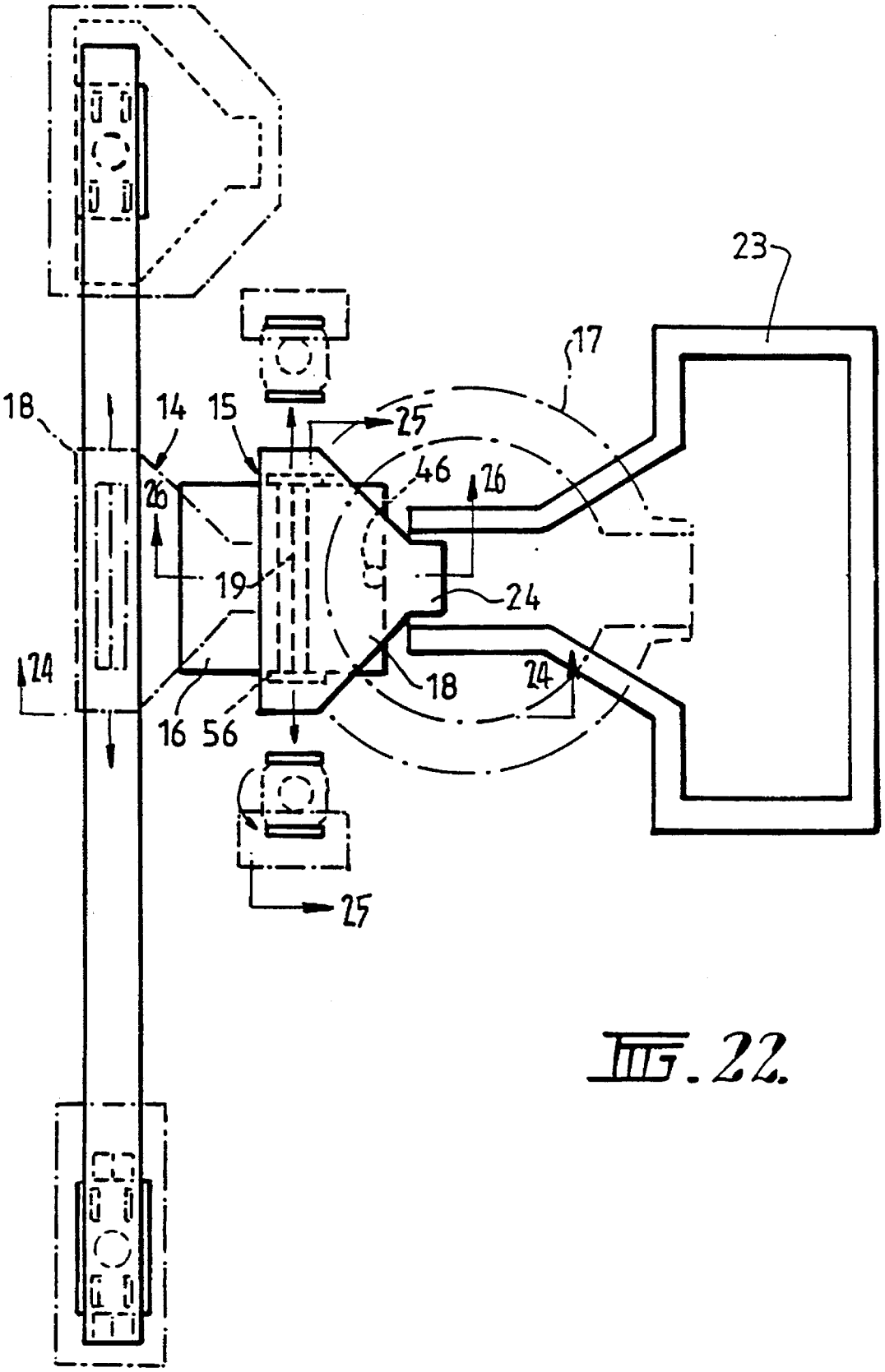
FIG. 22 is a plan view of a continuous strip caster which is operable in accordance with the invention.
Figure 23:
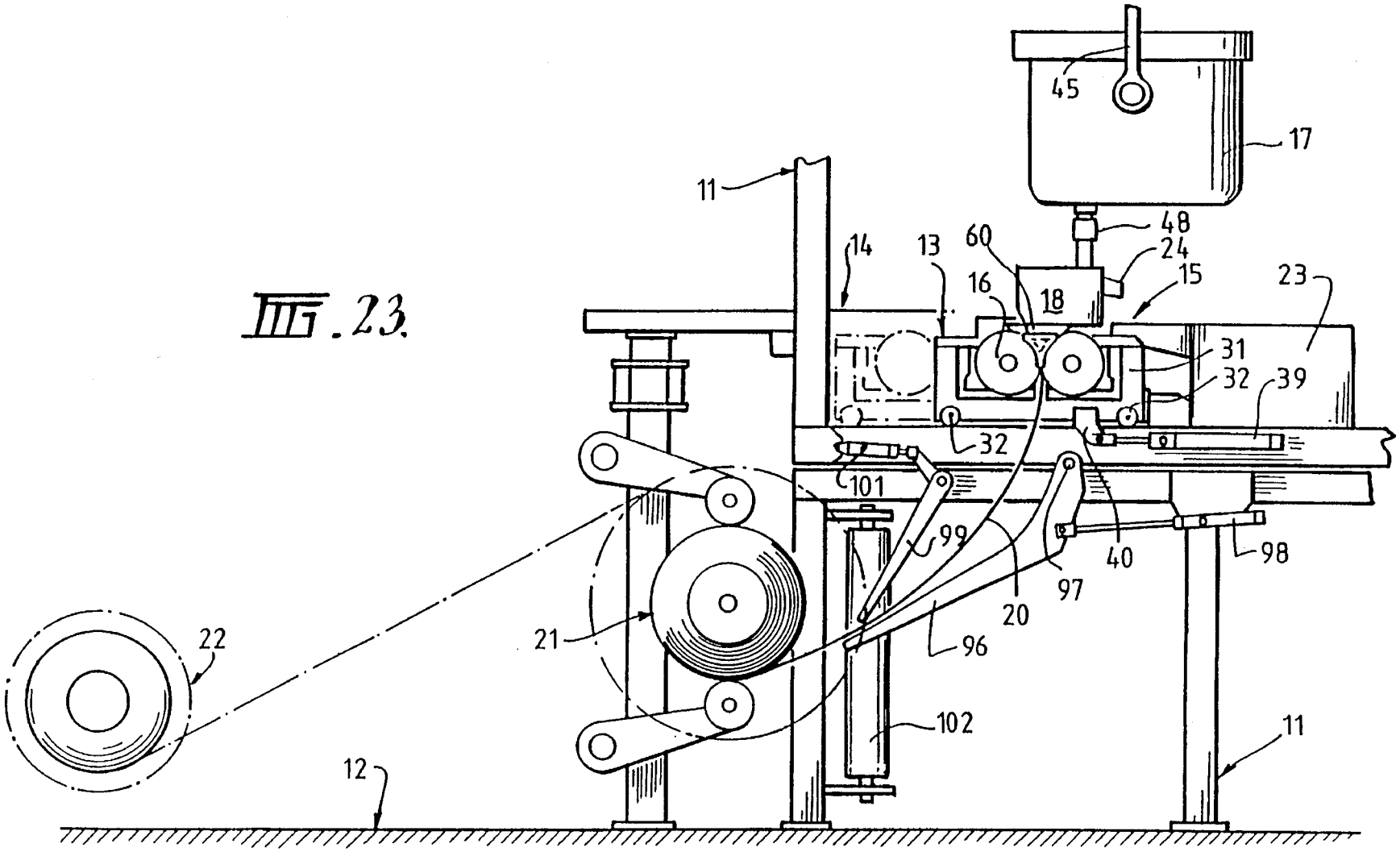
FIG. 23 is a side elevation of the strip caster shown in FIG. 22.
Figure 24:
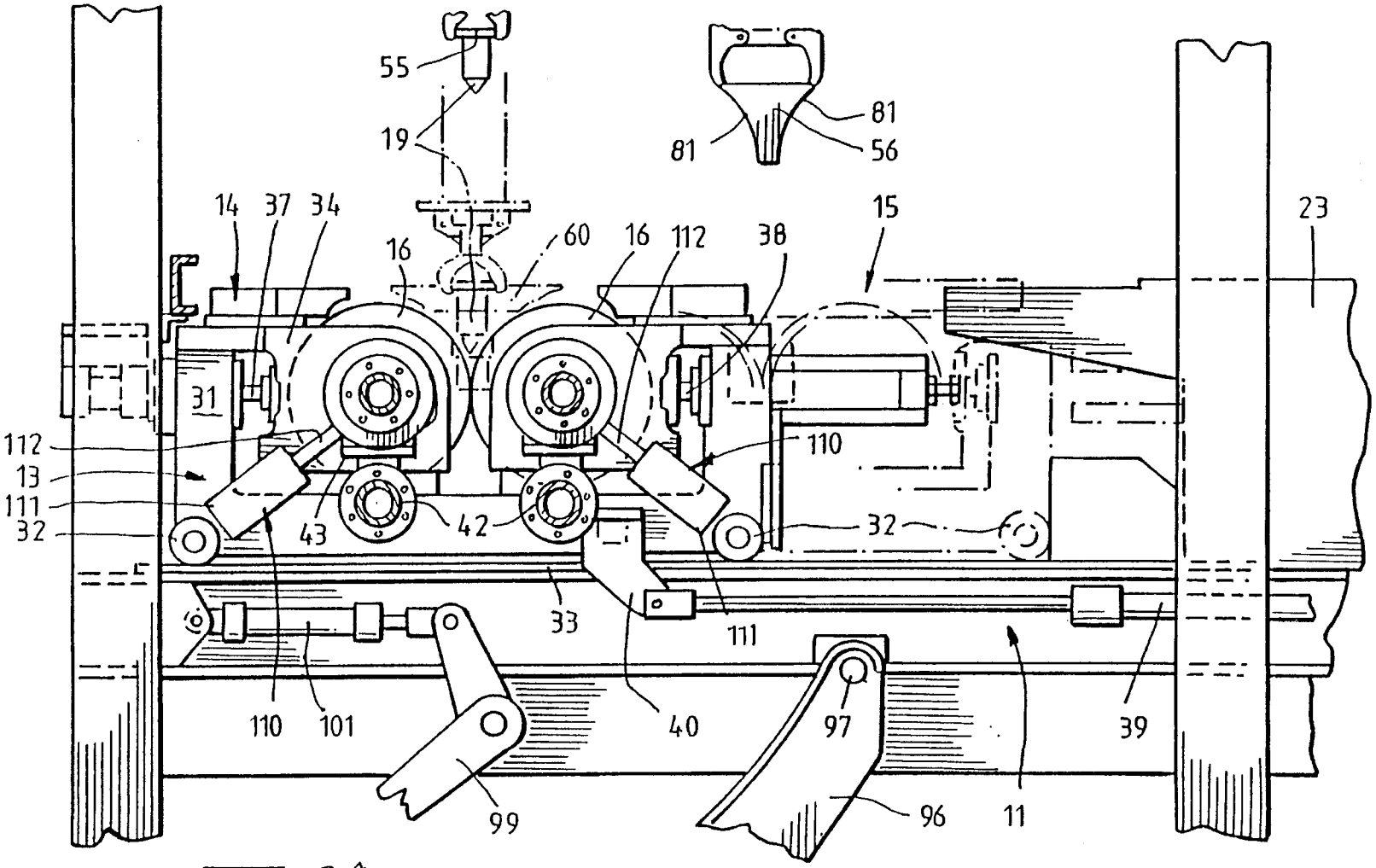
FIG. 24 is a vertical cross-section on the line 24—24 in FIG. 22.
Figure 25:
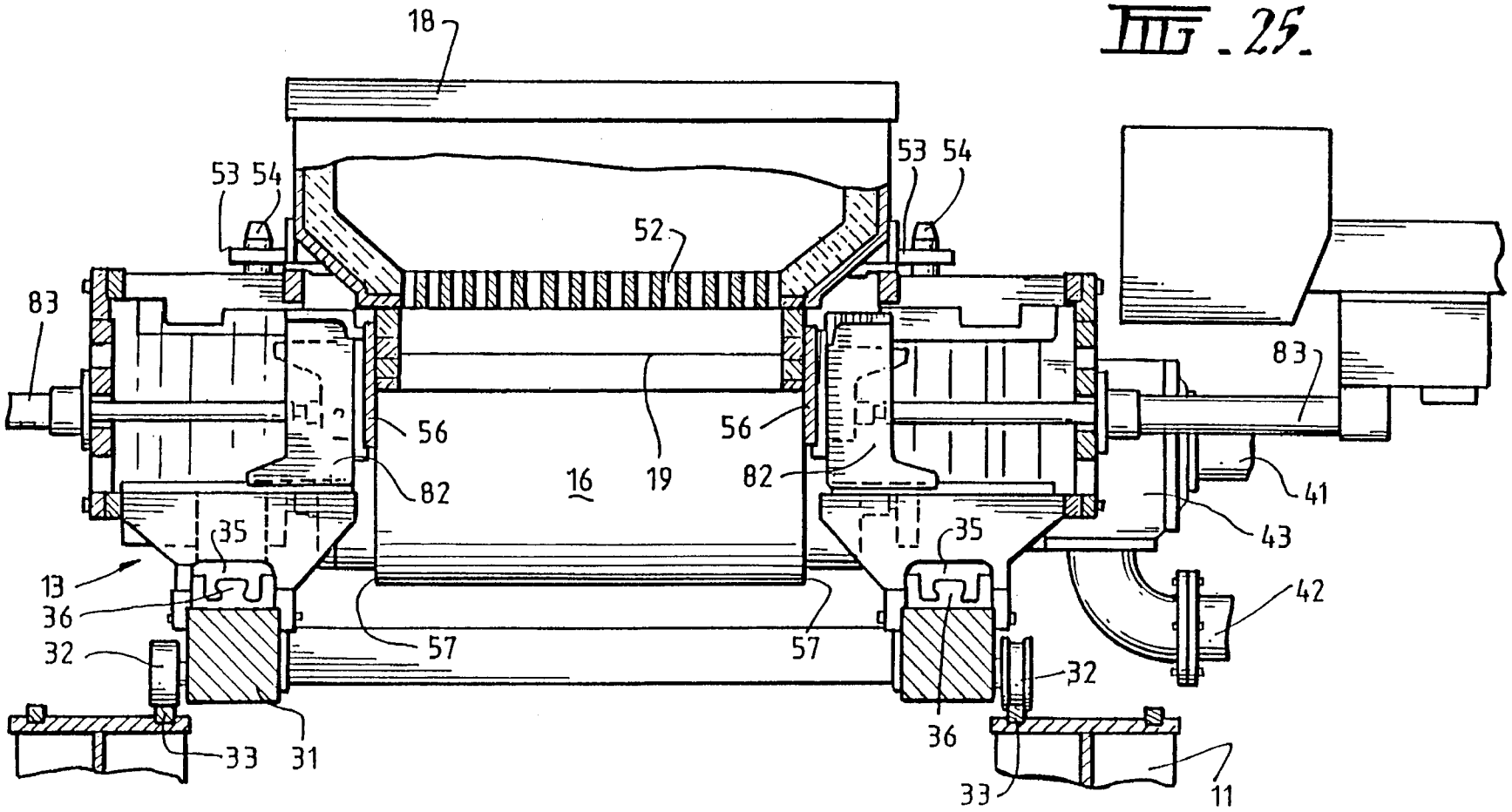
FIG. 25 is a vertical cross-section on the line 25—25 in FIG. 22.
Figure 26:
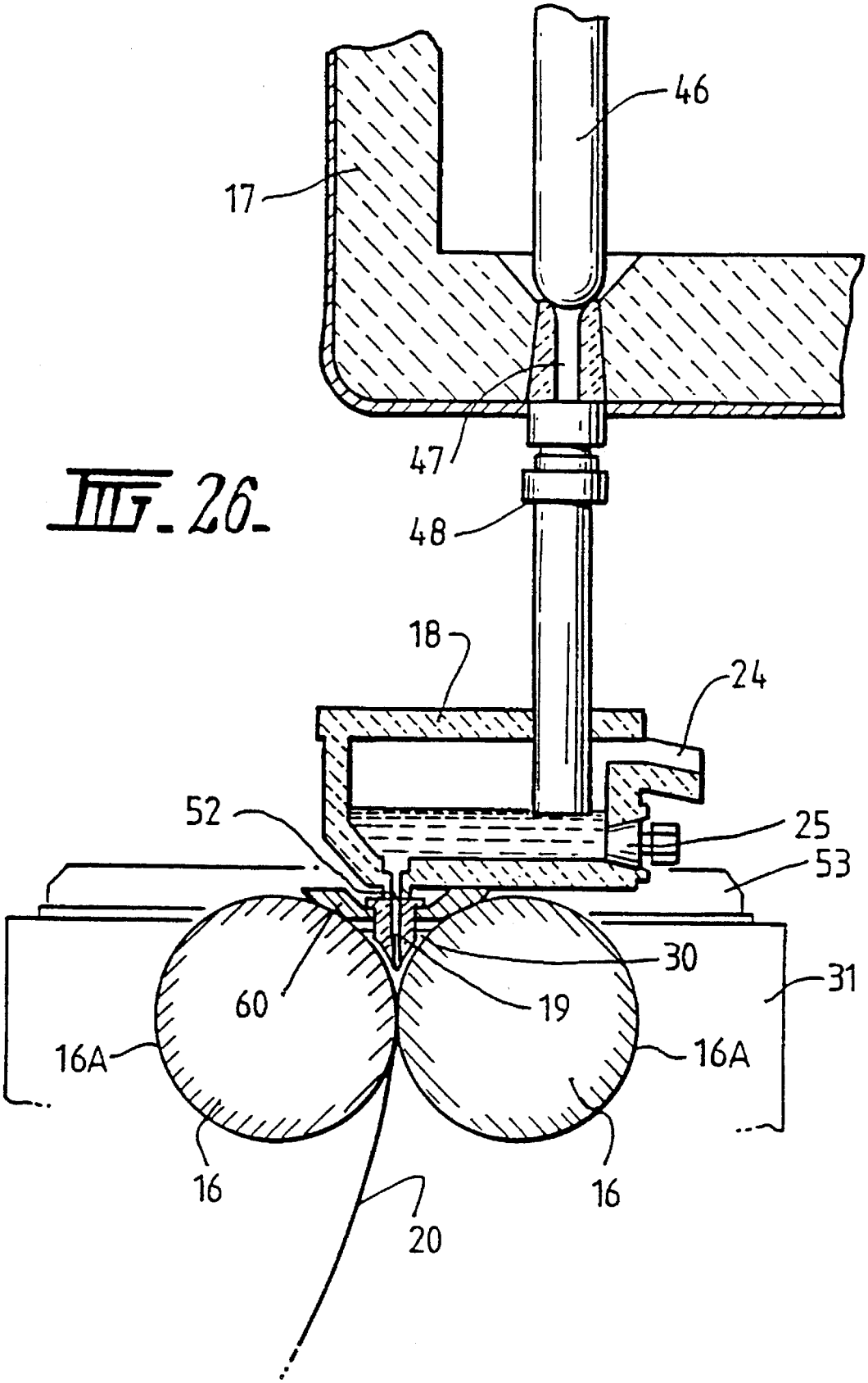
FIG. 26 is a vertical cross-section on the line 26—26 in FIG. 22.

FIG. 21 shows a comparison between the vibrational velocity for refinement predicted from equation (8) above and actual experimental results on 304 stainless steel, A06 carbon steel and 2011 aluminium alloy. The very good agreement between the experimental results and the prediction from the mathematical model suggests that the model is sound and can he used to predict the vibrational velocity requirements for other metals.

With smooth surfaces having an $R_a$ factor less than 0.2 with the application of vibrations of up to 20 kHz it was possible to achieve K factors in the range of 30 to 40. This has profound implications for the operation of the commercial strip casters in the production of steel strip. Previously it has been thought necessary to operate at a casting speed of 30–40 m/min to produce steel strip of 1–3 mm thickness. However at least in this range of operation the relation between the thickness T of the strip to be cast, the casting speed S and the solidification rate K are related generally by the formula $T \alpha K\ (1/S)^n$, where n=0.5. Accordingly a three fold increase of K factor as may be obtained accordingly to the invention means that it is possible to increase the thickness of the cast strip by three fold if the same casting speed is maintained. Alternatively, it may be possible to increase the casting speed by up to 9 times if the same strip thickness is maintained. For example for 2 mm strip it may be possible to achieve casting rates of the order of 4.5 m/sec. Accordingly the invention will enable casting strip speeds far in excess of any previously proposed continuous strip casters.

FIGS. 22 to 26 illustrate a twin roll continuous strip caster which can be operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

In accordance with the present invention the caster illustrated in FIGS. 22 to 26 can be operated in accordance with the present invention by the incorporation of transducer means 110 mounted on roll carriage frame 31 and operable to impart vibrations at the appropriate frequency and amplitude to produce surface structure refinement. The transducer means may conveniently take the form of a pair of electromechanical transducers slidably mounted together with appropriate reaction masses within a pair of transducer barrels 111 fixed to the roll carriage frame and acting directly on the roll shaft bearings through push rods 112. Since the increased heat transfer is due to vibration of the casting surfaces in compressional mode it is preferred to orient the transducers so as to vibrate the rolls normal to their casting surfaces at the casting pool. However when operating at relatively low vibrational frequencies this is not essential since significant compressional mode vibration will be developed at the roll surfaces regardless of the direction or manner of application.

The power requirement to vibrate the roll can be calculated in accordance with equation (9) given previously in this specification. The positioning of the transducers 110 on the roll carriage is recommended for producing vibrations at relatively low frequencies, for example, frequencies of the order of 0.5 kHz or less. In a typical strip caster installation fitted with rolls weighing of the order of 3 tonne the transducer may be Terfernol core magnetostrictive transducers having a total operating power of 15 kW.

Where it is necessary to apply vibrations at relatively high frequencies, the vibration may be applied directly onto the rolls. This can be achieved by mounting a number of magnetostrictive transducers inside the roll, or at the two ends of the roll to engage either end surfaces of the roll or the side plates in contact with those ends. For example the transducer may be attached directly to the roll carriage frame 31 or to one of the side closure plates 56. Alternatively, the vibrations may be applied to the molten metal by being attached to the metal delivery nozzle 19 or to the nozzle mounting bracket 60. In order to reduce the vibrating mass, the mounting bracket 60 may be supported on the roll carriage frame 31 through flexible mountings.

The illustrated apparatus has been advanced by way of example only and the invention is not limited to use of apparatus of this particular kind, or indeed to twin roll casting. It may, for example, be applied to a single roll caster or to a moving belt caster. It is accordingly to be understood that many modifications and variations will fall within the scope of the invention.

We claim:

1. A method of continuously casting metal strip comprising:

forming a casting pool of molten metal in contact with a moving casting surface;

solidifying metal from the pool onto the moving casting surface;

causing the casting surface to have an Arithmetical Mean Roughness Value ($R_a$) of less than 5 microns; and inducing relative vibratory movement between the molten metal of the casting pool and the casting surface.

2. A method as claimed in claim 1, wherein the casting surface has an Arithmetical Mean Roughness Value ($R_a$) of less than 0.5 microns and said induced vibratory movement has a frequency of no more than 20 kHz.

3. A method as claimed in claim 2, wherein the casting surface has an Arithmetical Mean Roughness Value ($R_a$) of less than 0.2 microns and said induced vibratory movement has a frequency in the range 0.5 to 20 kHz.

4. A method as claimed in claim 1, wherein the peak velocity of said induced relative vibratory movement is in the range determined by the formula $$\upsilon_{peak} = \frac{8.\sigma}{\pi \rho c R_c} \pm 50\%$$

where $\upsilon_{peak}$ is the peak velocity of the vibratory movement (m/s), $\sigma$ is the density of the molten metal (kg/m$^3$), c is the acoustic velocity in the molten metal, and $R_c$ is the critical radius of curvature for complete wetting conditions (m), as determined by the formula $$R_c = \frac{h_p}{\sin(180 - 2\mathrm{arctg}\ d/h_p)}$$

where $h_p$ is the half pitch distance between peaks of the casting surface as determined from the roughness of that surface (m); and d is the peak to valley depth of the casting surface as determined from the roughness of that surface (m).

5. A method of continuously casting metal strip comprising:

introducing molten metal into a nip between a pair of parallel casting rolls via a metal delivery nozzle disposed above the nip to create a casting pool of molten metal supported on casting surfaces of the rolls immediately above the nip;

counter-rotating the casting rolls to deliver a soldified metal strip downwardly from the nip;

causing the casting surfaces of the rolls to have an Arithmetical Mean Roughness Value ($R_a$) of less than 5 microns; and inducing a relative vibratory movement between the molten metal of the casting pool and the casting surfaces of the rolls.

6. A method as claimed in claim 5, wherein the casting surfaces of the rolls have an Arithmetical Mean Roughness Value ($R_a$) of less than 0.5 microns and said induced vibratory movement has a frequency of not more than 20 kHz.

7. A method as claimed in claim 6, wherein the casting surfaces of the rolls have an Arithmetical Mean Roughness Value ($R_a$) of less than 0.2 microns and said induced vibratory movement has a frequency in the range 0.5 to 20 kHz.

8. A method as claimed in claim 5, wherein the peak velocity of said induced relative vibratory movement is in the range determined by the formula $$\upsilon_{peak} = \frac{8.\sigma}{\pi\rho c R_c} \pm 50\%$$

where $\upsilon_{peak}$ is the peak velocity of the vibratory movement (m/s), $\sigma$ is the surface tension of the molten metal (N/m), $\rho$ is the density of the molten metal (kg/m$^3$), c is the acoustic velocity in the molten metal, and $R_c$ is the critical radius of curvature for complete wetting conditions (m), as determined by the formula $$R_c = \frac{h_p}{\sin(180 - 2\text{arc}tg\ d/h_p)}$$

where $h_p$ is the half pitch distance between peaks of the casting surfaces of the rolls as determined from the roughness of those surfaces (m); and d is the peak to valley depth of the casting surfaces of the rolls as determined from the roughness of those surfaces (m).

9. A method as claimed in claim 8, wherein said peak velocity is in the range determined by the formula $$\upsilon_{peak} = \frac{8.\sigma}{\pi\rho c R_c} \begin{matrix} +10\% \\ -50\% \end{matrix}$$

10. A method as claimed in claim 5, wherein the casting surfaces have an Arithmetical Mean Roughness Value ($R_a$) of less than 0.25 microns and the peak velocity of said induced relative vibratory movement is in the range 0.02 to 0.06 m/s.

11. A method as claimed in claim 5, wherein said metal is a low carbon steel of less than 0.15% carbon, the casting surfaces have an Arithmetical Mean Roughness Value ($R_a$) of less than 0.25 microns and the peak velocity of said induced relative vibratory movement is in the range 0.015 to 0.05 m/s.

12. A method as claimed in claim 5, wherein said metal is aluminium, the casting surfaces have an Arithmetical Mean Roughness Value ($R_a$) of less than 0.25 microns and the peak velocity of said induced relative vibratory movement is in the range 0.06 to 0.10 m/s.

13. A method as claimed in claim 9 to 10, wherein the frequency of said induced relative vibratory movement is no more than 20 kHz.

14. A method as claimed in claim 7 to 8, wherein the casting rolls are rotated at such speed as to deliver the solidified metal strip at a strip speed in the range 0.5 to 5 m/s.

15. A method as claimed in claim 14, wherein the solidified metal strip as delivered downwardly from the nip between the casting rolls has a thickness in the range 1 to 5 mm.

16. A method as claimed in claim 5, wherein the molten metal solidifies on the casting surfaces of the rolls at nucleation sites spaced at a nucleation density of at least 400 nuclei/mm$^2$.

17. A method as claimed in claim 16, wherein said nucleation density is in the range 600 to 700 nuclei/mm$^2$.

18. A method as claimed in any one of claims 4 to 5, wherein said relative vibratory movement is induced by vibrating the casting rolls.

19. A method as claimed in claim 15, wherein said relative vibratory movement is induced by means of transducer means attached to a structure supporting or in contact with the casting rolls.

20. Apparatus for continuously casting metal strip comprising a pair of parallel casting rolls forming a nip between them, a metal delivery nozzle for delivery of molten metal into the nip between the casting rolls to form a casting pool of molten metal supported on casting roll surfaces immediately above the nip, roll drive to drive the casting rolls in counter-rotational direction to produce a solidified strip of metal delivered downwardly from the nip, and vibration means operable to induce relative vibratory movement between the molten metal of the casting pool and the casting surfaces of the rolls, wherein the casting surfaces of the casting rolls have an ArithmetiCal Mean Roughness Value ($R_a$) of less than 5 microns.

21. Apparatus as claimed in claim 20, wherein the casting surfaces of the rolls have an Arithmetical Mean Roughness Value ($R_a$) of less than 0.5 microns and said vibration means is operable to induce said relative vibratory movement at a frequency of no more than 20 kHz.

22. Apparatus as claimed in claim 21, wherein the casting surfaces of the rolls have an Arithmetical Mean Roughness Value ($R_a$) of less than 0.2 microns and said vibration means is operable to induce said relative vibratory movement at a frequency in the range 0.5 to 20 kHz.

23. Apparatus as claimed in claim 20, wherein said vibration means is operable to induce said relative vibratory movement with a peak vibrational velocity in the range 0.015 to 0.06 m/s.

24. Apparatus as claimed in claim 20, wherein said vibration means is operable to induce said relative vibratory movement with a peak vibrational velocity in the range 0.06 to 0.10 m/s.

25. Apparatus as claimed in claim 20, wherein said vibrational means comprises a transducer means attached to a structure supporting or in contact with the casting rolls.

* * * * *

UNITED STATES PATENT AND TRADEMARK OFFICE

CERTIFICATE OF CORRECTION

PATENT NO. : 5,520,243

DATED : May 28, 1996

INVENTOR(S) : Freeman et al.

It is certified that error appears in the above-indentified patent and that said Letters Patent is hereby corrected as shown below:

ON THE TITLE PAGE:

Item [87], line 1, delete "WO95/09110" insert therefor -- WO94/12300 --.

Item [87], line 2, delete "April 6, 1995" insert therefor -- June 9, 1994 --.

Signed and Sealed this

Twenty-ninth Day of October 1996

*Attest:*

*Attesting Officer*

BRUCE LEHMAN

*Commissioner of Patents and Trademarks*